US011135706B2

(12) United States Patent
Hughes et al.

(10) Patent No.: US 11,135,706 B2
(45) Date of Patent: Oct. 5, 2021

(54) INDUSTRIAL TOOL AND DRIVE SYSTEM FOR SAME

(71) Applicant: Enerpac Tool Group Corp., Menomonee Falls, WI (US)

(72) Inventors: Nathan Adam Hughes, Cottage Grove, WI (US); Roger Roy Pili, Cambridge, WI (US)

(73) Assignee: Enerpac Tool Group Corp., Menomonee Falls, WI (US)

( * ) Notice: Subject to any disclaimer, the term of this patent is extended or adjusted under 35 U.S.C. 154(b) by 256 days.

(21) Appl. No.: 16/154,511

(22) Filed: Oct. 8, 2018

(65) Prior Publication Data

US 2019/0105762 A1 Apr. 11, 2019

Related U.S. Application Data

(60) Provisional application No. 62/569,085, filed on Oct. 6, 2017.

(51) Int. Cl.

| | |
|---|---|
| ***B25B 21/00*** | (2006.01) |
| ***B25B 23/145*** | (2006.01) |
| *B25B 23/00* | (2006.01) |

(52) U.S. Cl.

CPC ..... *B25B 21/005* (2013.01); *B25B 23/0078* (2013.01); *B25B 23/1453* (2013.01)

(58) Field of Classification Search

CPC ..... B25B 21/005; B25B 23/0078; B25B 23/0071; B25B 23/1453; B25B 21/004;

(Continued)

(56) References Cited

U.S. PATENT DOCUMENTS 2,505,786 A * 5/1950 Mork ..... F15B 15/204 91/209
4,339,968 A * 7/1982 Krieger ..... B25B 21/005 81/57.39

(Continued)

FOREIGN PATENT DOCUMENTS

CN 1272416 A 11/2000
CN 1429690 A 7/2003

(Continued)

OTHER PUBLICATIONS

Chinese Patent Office Action for Application No. 201811169195.7 dated Apr. 28, 2020 (9 pages, statement of relevance included).

(Continued)

*Primary Examiner* — Robert J Scruggs
(74) *Attorney, Agent, or Firm* — Michael Best & Friedrich LLP

(57) ABSTRACT

A drive system for an industrial tool (e.g., a hydraulic torque wrench) includes a cylinder, a first piston, a first rod, a second piston, and a second rod. The cylinder includes a first end, a second end, and a longitudinal axis extending therebetween. The first piston is disposed within the cylinder and movable along the longitudinal axis. The first rod is coupled to the first piston and extends toward the first end of the cylinder. The second piston is disposed within the cylinder and movable along the longitudinal axis. The second rod is coupled to the second piston and extends toward the first end of the cylinder.

12 Claims, 7 Drawing Sheets

(58) Field of Classification Search
CPC ... B25B 21/002; B25B 21/001; B25B 21/007; B25B 21/008; B25B 13/463; B25B 21/00; B25B 23/00; B25B 23/145
See application file for complete search history.

(56) References Cited

U.S. PATENT DOCUMENTS

| | | | | |
|---|---|---|---|---|
| 5,005,447 | A | 4/1991 | Junkers | |
| 5,329,833 | A * | 7/1994 | Sergan | B25B 21/005 81/57.39 |
| 6,068,068 | A | 5/2000 | Turoff | |
| 6,112,622 | A * | 9/2000 | Reiman | B25B 21/005 81/57.39 |
| 6,802,235 | B2 * | 10/2004 | Junkers | B25B 21/005 81/57.39 |
| 9,512,888 | B2 | 12/2016 | Downs et al. | |
| 2014/0238203 | A1 * | 8/2014 | Spirer | B25B 21/005 81/57.39 |

FOREIGN PATENT DOCUMENTS

| | | | |
|---|---|---|---|
| CN | 203510053 | U | 4/2014 |
| CN | 106239416 | A | 12/2016 |
| CN | 205817690 | U | 12/2016 |
| CN | 206185768 | U | 5/2017 |
| EP | 1325794 | A1 | 7/2003 |
| GB | 2449638 | A | 12/2008 |
| RU | 2510614 | C1 | 4/2014 |

OTHER PUBLICATIONS

Search Report issued from the European Patent Office for related Application No. 18199085.4 dated Feb. 25, 2019 (9 pages).
Second Office Action issued from the Chinese Patent Office for related Application No. 201811169195.7 dated Dec. 14, 2020 (11 Pages including Statement of Relevance).
Examination Report issued from the European Patent Office for related Application No. 18199085.4 dated Nov. 30, 2020 (5 Pages).

* cited by examiner

INDUSTRIAL TOOL AND DRIVE SYSTEM FOR SAME

REFERENCE TO RELATED APPLICATION

This application claims the benefit of prior-filed U.S. Provisional Patent Application No. 62/569,085, filed Oct. 6, 2017, the entire contents of which are incorporated by reference.

FIELD

The present disclosure relates to industrial tools, and particularly to hydraulic torque wrenches.

SUMMARY

Industrial tools such as hydraulic torque wrenches use pressurized fluid to apply large torques to a workpiece (e.g., fastener, nut, etc.). In particular, application of pressurized fluid to a piston drives a socket to rotate in a first direction. A ratchet device permits a drive socket to drive the fastener in a first direction. For example, a locking pawl may engage the socket to rotate the socket, but the workpiece is inhibited from rotating in an opposite direction as the locking pawl slides relative to the drive sprocket. Hydraulic torque wrenches may also include sensors and/or gauges for determining the amount of torque applied to the workpiece.

In one aspect, a drive system for an industrial tool includes a cylinder, a first piston, a first rod, a second piston, and a second rod. The cylinder includes a first end, a second end, and a longitudinal axis extending therebetween. The first piston is disposed within the cylinder and movable along the longitudinal axis. The first rod is coupled to the first piston and extends toward the first end of the cylinder. The second piston is disposed within the cylinder and movable along the longitudinal axis. The second rod is coupled to the second piston and extends toward the first end of the cylinder.

In another aspect, a hydraulic torque wrench includes a drive system and a working end driven by the drive system. The drive system includes a cylinder, a first piston, a first rod coupled to the first piston, a second piston, and a second rod coupled to the second piston. The cylinder includes a first end, a second end, and a longitudinal axis extending therebetween. The first piston is disposed within the cylinder and movable along the longitudinal axis. The second piston is disposed within the cylinder and movable along the longitudinal axis. The working end includes a first arm coupled to the first rod, a second arm coupled to the second rod, and a socket operable to be driven by the first arm and the second arm.

In yet another aspect, a hydraulic torque wrench includes a fluid actuator and a working end driven by the fluid actuator. The fluid actuator includes a cylinder, a first piston moveable along a longitudinal axis under the influence of pressurized fluid in a first chamber, and a second piston moveable along the longitudinal axis under the influence of pressurized fluid in a second chamber. The working end includes a socket, a first arm coupled to and actuated by movement of the first piston, and a second arm coupled to and actuated by the second piston. Reciprocal movement of the first arm and the second arm driving rotation of the socket in a single direction of rotation.

Other aspects will become apparent by consideration of the detailed description and accompanying drawings.

DETAILED DESCRIPTION

Before any independent embodiments are explained in detail, it is to be understood that the disclosure is not limited in its application to the details of construction and the arrangement of components set forth in the following description or illustrated in the following drawings. The disclosure is capable of other independent embodiments and of being practiced or of being carried out in various ways. Also, it is to be understood that the phraseology and terminology used herein is for the purpose of description and should not be regarded as limiting.

Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

Figure 1:
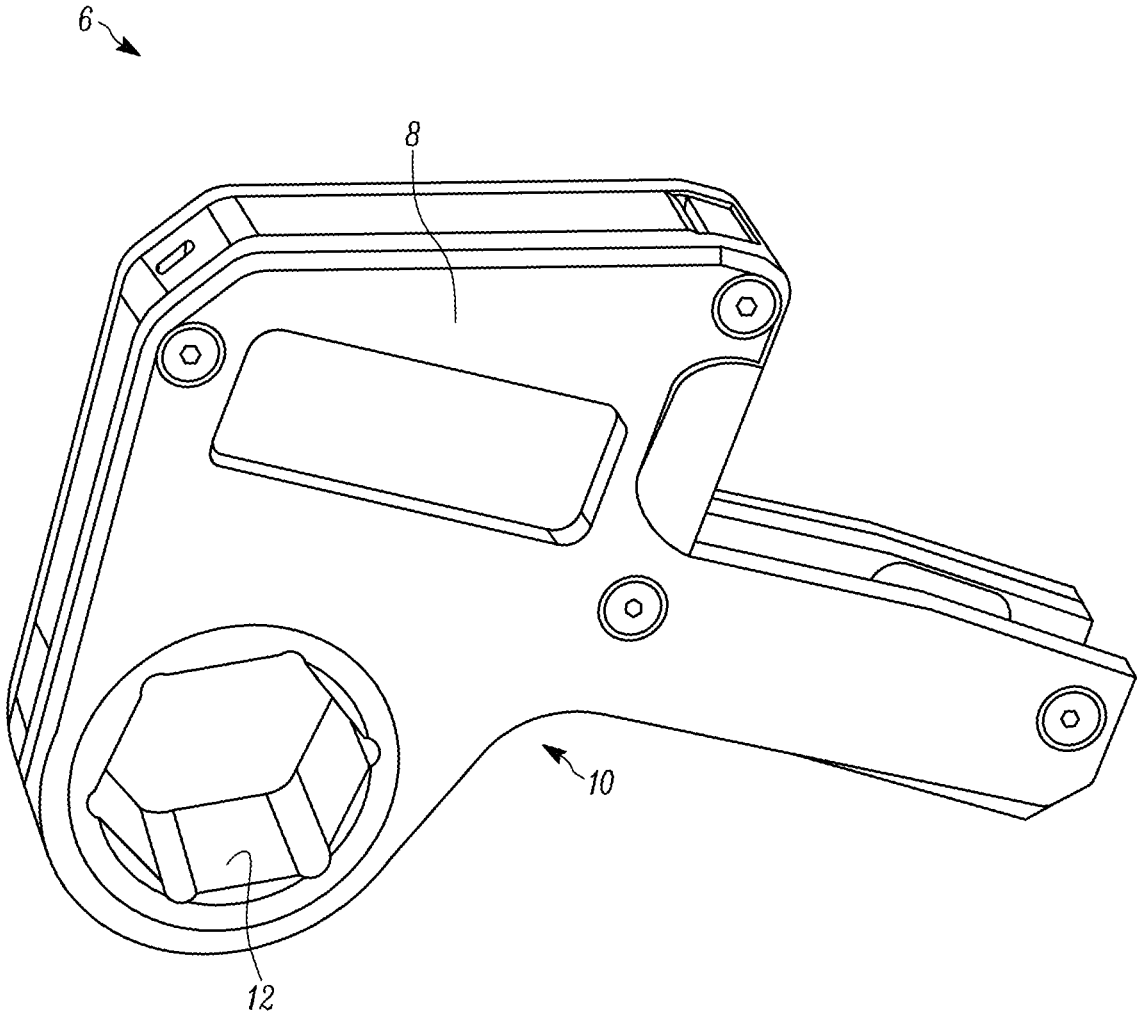
FIG. 1 is a perspective view of a hydraulic torque wrench.
Figure 2:
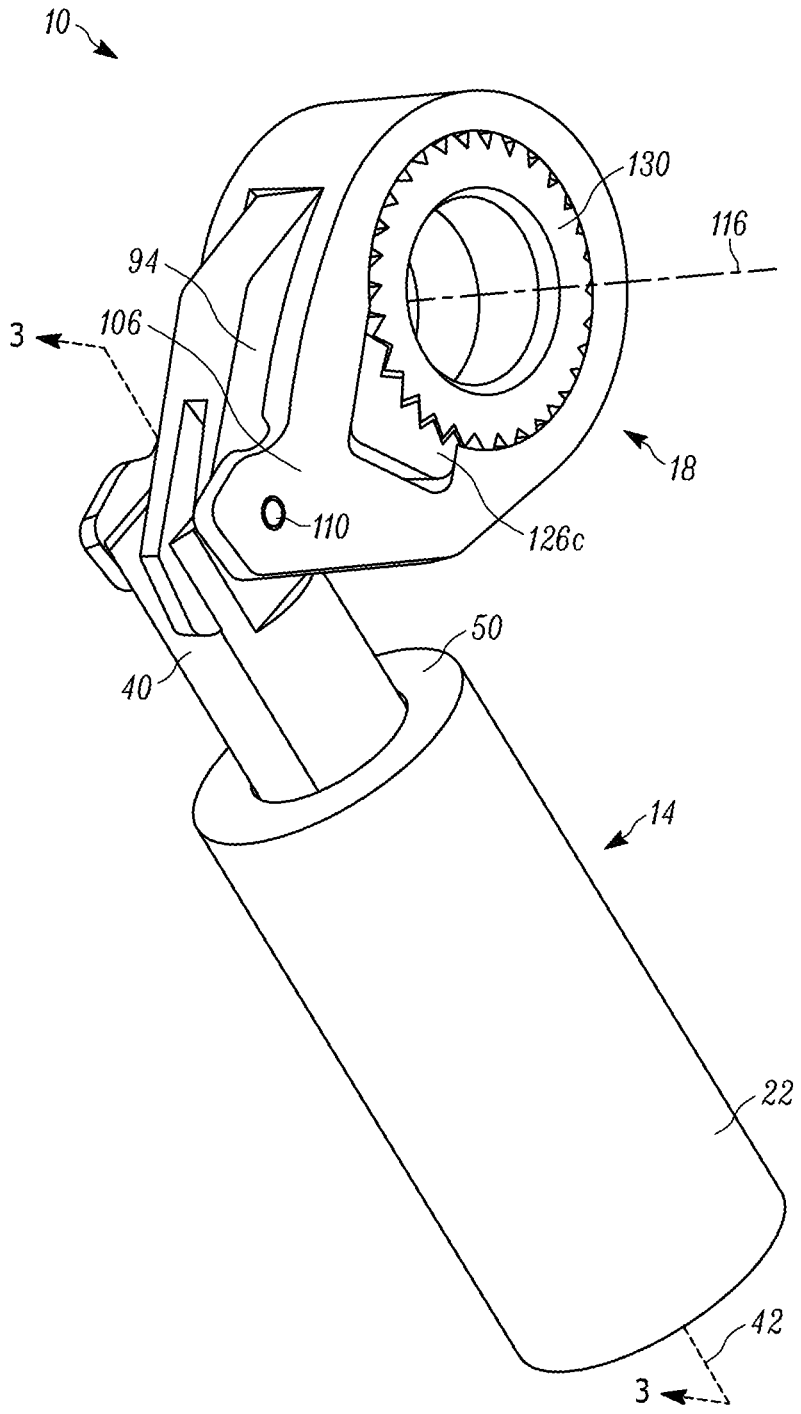
FIG. 2 is a perspective view of a drive system for a hydraulic torque wrench in a first position.

FIG. 1 illustrates an industrial tool, such as a hydraulic torque wrench 6 for applying torque to a fastener. The torque wrench 6 includes a cassette or housing 8 and a drive system 10 for driving a socket 12. As shown in FIG. 2, the drive system 10 includes a fluid actuator 14 disposed within the housing 8 (FIG. 1), and a driver or working end 18. The working end 18 is driven by the fluid actuator 14 and also supported by the housing 8. In other embodiments, the fluid actuator 14 may drive a working end for a different type of industrial tool.

Figure 3:
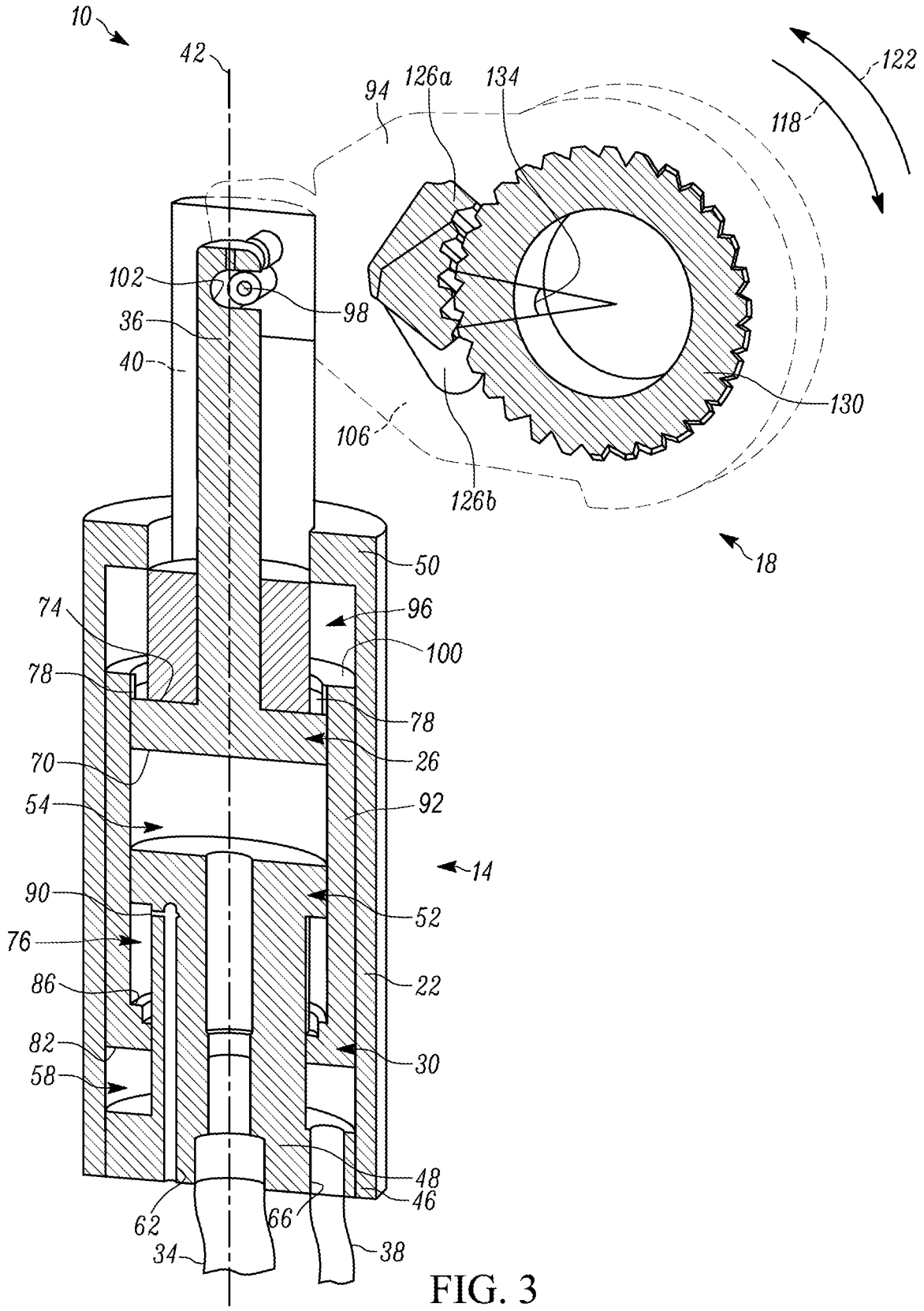
FIG. 3 is a perspective cross-section view along line 3-3 of the drive system of FIG. 2.

As best shown in FIG. 3, the fluid actuator 14 includes a cylinder 22 supporting two reciprocating pistons (i.e., a first piston 26 and a second piston 30). The fluid actuator 14 is in fluid communication with an external source of pressurized fluid (such as a pump—not shown) via one or more fluid hoses, which can include passages 34, 38. In some embodiments, the hose(s) is connected to the housing 8 and placed in fluid communication with the fluid actuator 14 by a quick disconnect coupler, although other types of connections are possible.

Figure 4:
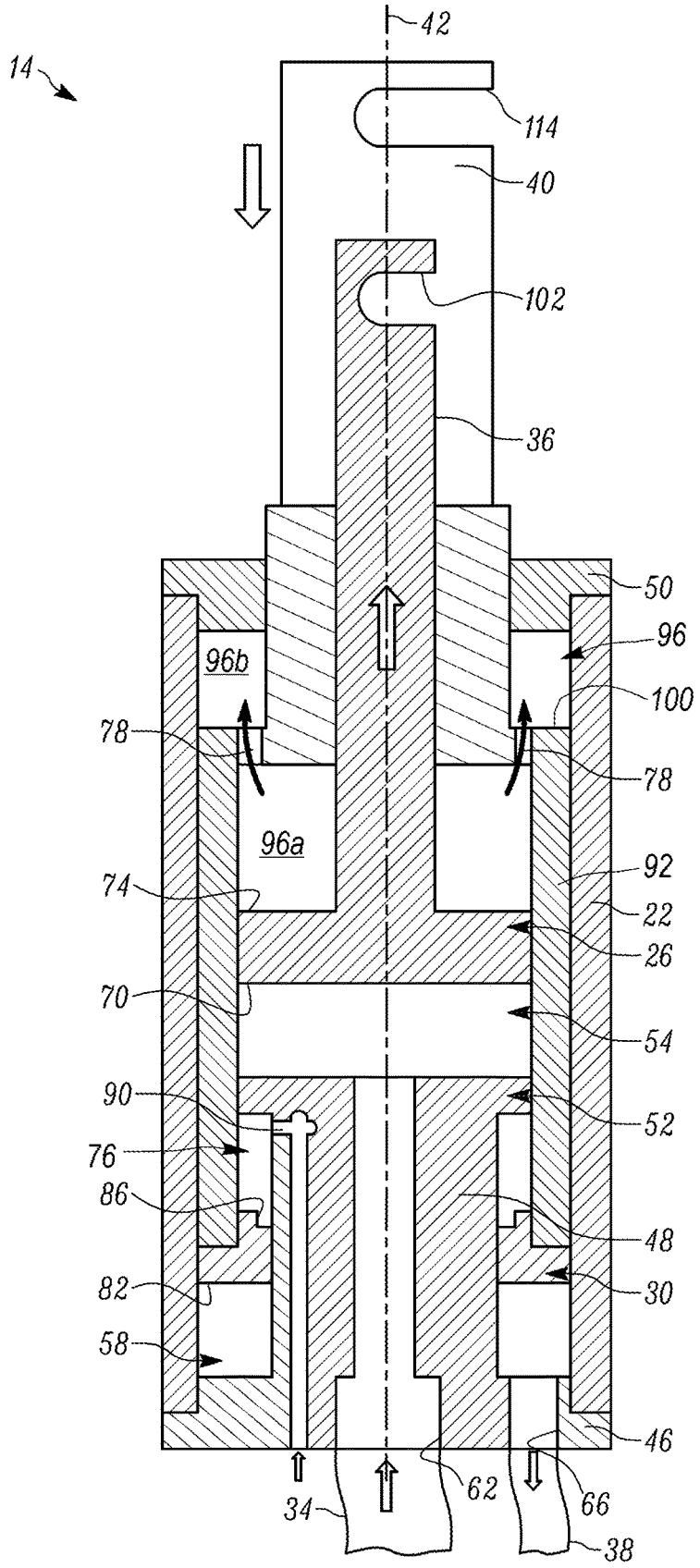
FIG. 4 is cross-section view of a fluid actuator, illustrating pressurized fluid entering a first chamber and exiting a second chamber.

Referring to FIGS. 3 and 4, the first piston 26 is coupled to a first rod 36 and the second piston 30 is coupled to a second rod 40, and each piston 26, 30 reciprocates along a longitudinal axis 42. The cylinder 22 includes a first cap 46 disposed on one end of the cylinder 22 and a second cap 50 disposed on an opposite end of the cylinder 22. In the illustrated embodiment, the cylinder 22 also includes a stem 48 extending from an inner surface of the first cap 46 and toward the opposite end of the cylinder 22. A flange or partition 52 is positioned on a distal end of the stem 48 positioned between the first cap 46 and the second cap 50. The partition 52 is positioned axially between the second piston 30 and the first piston 26. A first advance chamber or first fluid chamber 54 is positioned adjacent a side of the first piston 26, between the first piston 26 and the partition 52. A second advance chamber or second fluid chamber 58 is positioned adjacent a side of the second piston 30, between the second piston 30 and the partition 52. In the illustrated embodiment, a first fluid port 62 extends through the first cap 46 and the stem 48, and is in fluid communication with the first fluid chamber 54 to permit pressurized fluid to enter and exit the first chamber 54. A second fluid port 66, also extending through the first cap 46, is in fluid communication with the second fluid chamber 58 and permits pressurized fluid to enter and exit the second chamber 58.

In the illustrated embodiment, the first and second pistons 26, 30 are co-axial with each other, and a body of the second piston 30 extends around the first piston 26. In the illustrated embodiment, the second piston 30 is positioned at an end of a cylindrical body 92, and both the first piston 26 and the partition 52 are positioned in the cylindrical body 92. The first piston 26 includes a cap side 70 that is adjacent the first chamber 54 and a rod side 74 that is adjacent a third chamber 72. Further, the second piston 30 includes a cap side 82 that is adjacent the second chamber 58 and a rod side 86 that is adjacent a fourth chamber 76. The fourth chamber 76 is in communication with a fluid passage 90, and in some embodiments the fluid passage 90 is a vent in communication with an ambient environment.

In the illustrated embodiment, the first piston 26 and first rod 36 are nested with respect to the second piston 30 and second rod 40. In some embodiments, the first rod 36 and the second rod 40 are configured to be concentric with one another, and can be positioned concentric with the longitudinal axis 42. The first piston 26 is positioned within the cylindrical body 92, between the second piston 30 and an opposite end 100 of the body 92. The cap side 70 of the first piston 26 faces toward the rod side 86 of the second piston 30, and the partition 52 is positioned between the first piston 26 and the second piston 30. The third chamber 96 has two portions 96*a*, 96*b*, and a fluid passage 78 provides communication between the portions 96*a*, 96*b*. The first portion 96*a* is positioned in the body 92, between the rod side 74 of the first piston 26 and the opposite end 100 of the body 92. The second portion 96*b* is positioned in the cylinder 22, between the second cap 50 and the opposite end 100 of the cylindrical body 92. The first portion 96*a* and the second portion 96*b* are in communication with one another by a fluid passage 78.

In some embodiments, the third chamber 96 is a common retraction chamber for the first piston 26 and second piston 30. Fluid may enter the first portion 96*a* when the first piston 26 and first rod 36 retract. Similarly, fluid may enter the second portion 96*b* when the second piston 30 and second rod 40 retract. The first portion 96*a* and second portion 96*b* may form a closed system in which a discrete amount of fluid is transferred back and forth between the first portion 96*a* and the second portion 96*b* through the fluid passage 78. Also, in some embodiments, at least one of the third chamber 96 and the fluid passage 90 is in fluid communication with an ambient environment.

The cap side 70 of the first piston 26 includes a first cross-sectional area and the cap side 82 of the second piston 30 includes a second cross-sectional area. In the illustrated embodiment, the second cross-sectional area is a surface area between an outer diameter of the second piston 30 and an inner hole through which the stem 48 passes (i.e., the surface area of cap side 82). The second cross-sectional area is substantially equal to the first cross-sectional area (i.e., surface area of the cap side 70 of the first piston 26), ensuring that the amount of fluid displaced by movement of the first piston 26 is substantially the same as the amount of fluid displaced by movement of the second piston 30. Further, the chamber adjacent the rod side 74 of the first piston 26 defines a first volume and the chamber adjacent the rod side 86 of the second piston 30 defines a second volume that is substantially equal to the first volume.

As best shown in FIG. 3, the first and second rods 36, 40 extend through the second cap 50 of the cylinder 22 and are coupled to the working end 18 of the torque wrench 10. The working end 18 includes a first arm 94 coupled to and driven by the first rod 36. In the illustrated embodiment, a first pin 98 is coupled to the first arm 94 and is received within a first slot 102 of the first rod 36. Similarly, the working end 18 also includes a second arm 106 coupled to and driven by the second rod 40. For example, a second pin 110 coupled to the second arm 106 is received within a second slot 114 of the second rod 40. The pin-and-slot couplings enable the first arm 94 and second arm 106 to pivot along an arcuate path extending partially about an axis of rotation 116 (FIG. 2). The first arm 94 and the second arm 106 pivot in a first direction 118 and a second direction 122 in response to movement of the first rod 36 and second rod 40 moving in a straight path along the longitudinal axis 42. The first pin 98 and second pin 110 can move in both a direction parallel to the longitudinal axis 42 and also a direction transverse to the longitudinal axis 42, and thus the coupling between the pins 98, 110 and elongated slots 102, 114 facilitates movement of the first and second arms 94, 106 relative to the first and second rods 36, 40 without jamming or binding.

In the illustrated embodiment, the second rod 40 is split into multiple portions, and the second arm 106 of the working head 18 is split into multiple portions or links, each of which are coupled to an associate portion of the second rod 40. The first rod 36 is positioned between the portions of the second rod 40, and the first arm 94 is positioned between the two links of the second arm 106. The nested configuration facilitates direct axial loading between the first piston 26 and the first arm 94, and direct axial loading between the second piston 30 and the two portions of the arm 106. As a result, offset or oblique loading (that is, loads that are non-parallel to the axis 42) between the pistons 26, 30 and the arms 94, 106 is reduced or avoided, thereby improving operation and working life of the components of the drive system 10.

As shown in FIGS. 2 and 3, the working end 18 further includes a plurality of pawls 126*a-c* and a sprocket 130. In the illustrated embodiment, the sprocket 130 is positioned adjacent an outer surface of the socket 12 (FIG. 1), and rotation of the sprocket 130 drives the socket 12 to rotate. The sprocket 130 is alternatively driven by a subset of the pawls 126*a-c* in each stage of an operation cycle. In the illustrated embodiment, the first pawl 126*a* is supported on the first arm 94 (FIG. 3), while the second and third pawls 126*b*, 126*c* are each supported by one of the portions of the second arm 106 (FIGS. 2 and 3). In order to more evenly distribute loads with respect to the sprocket 130, the pawls 126*a-c* are spaced apart along a thickness of the sprocket 130 or along an axis of rotation 116 (FIG. 2) of the sprocket 130 (that is, in a direction transverse to the longitudinal axis 42). Each pawl 126*a-c* is biased or urged toward the sprocket 130.

Figure 5:
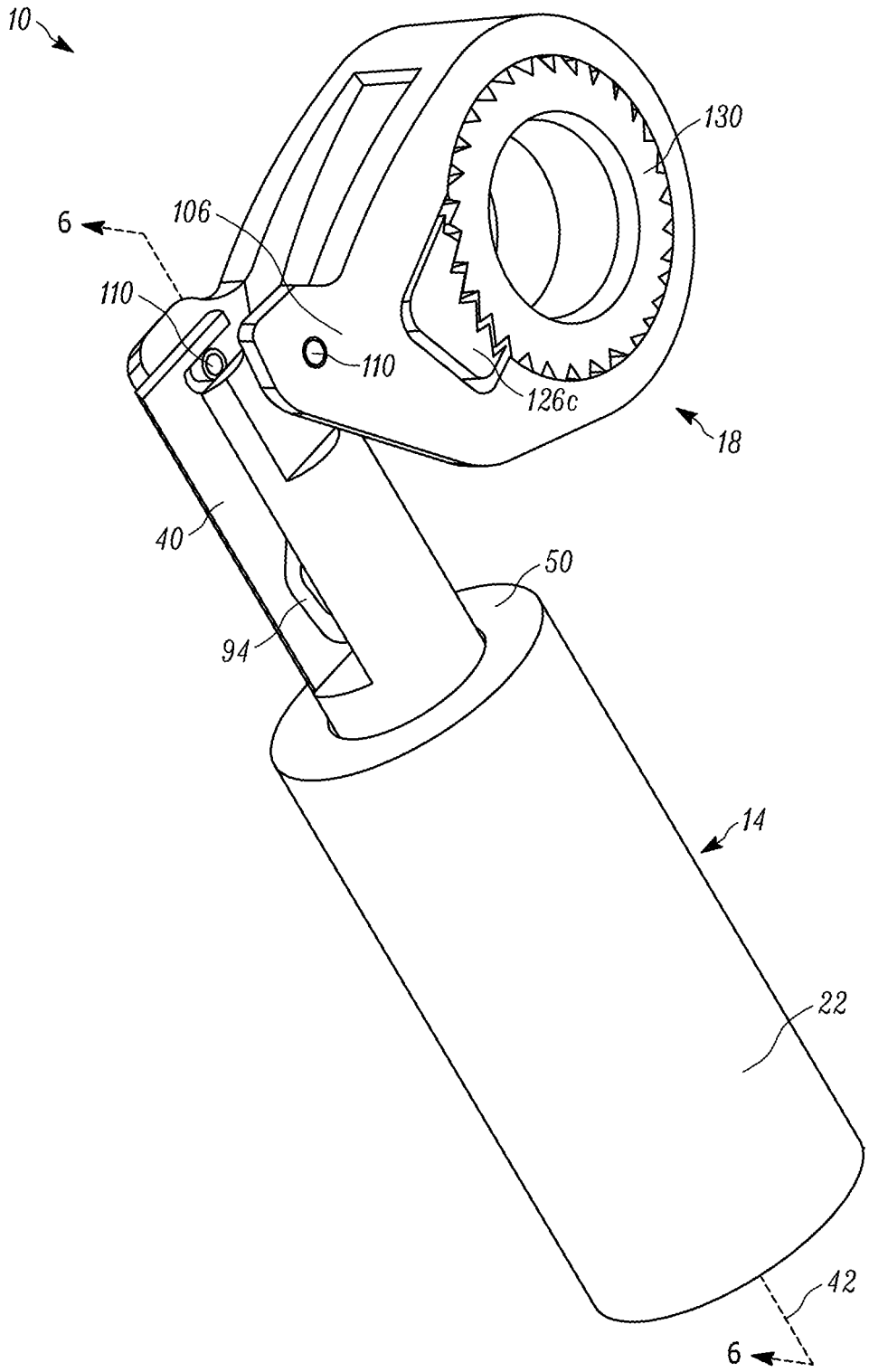
FIG. 5 is a perspective view of the drive system of FIG. 2 in a second position.
Figure 6:
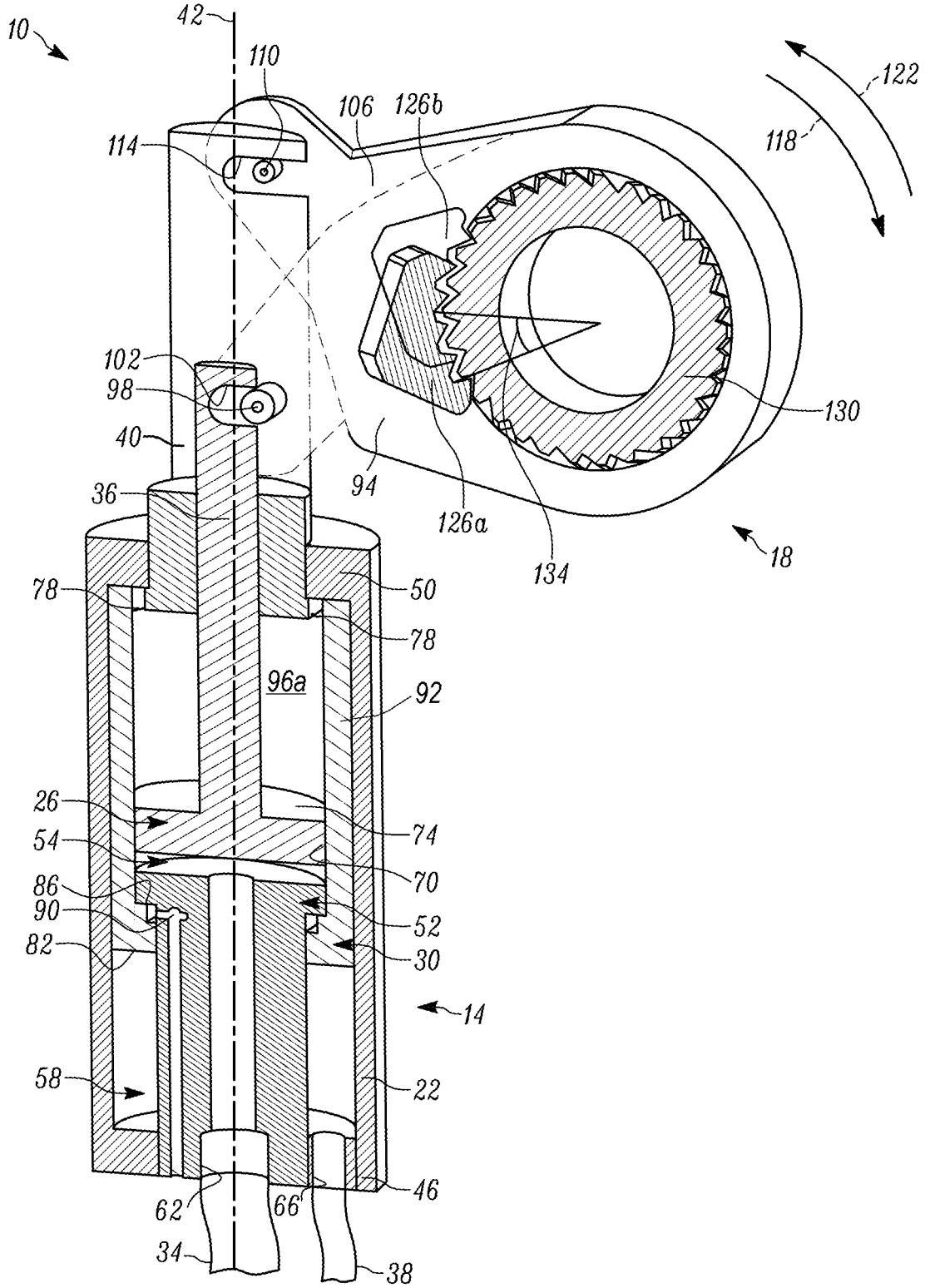
FIG. 6 is a perspective cross-section view along line 6-6 of the drive system of FIG. 5.

The first piston 26 is moveable along the longitudinal axis 42 between an extended position (FIGS. 2 and 3) and a retracted position (FIGS. 5 and 6). In the extended position, pressurized fluid is supplied to the first chamber 54. In the retracted position, the pressurized fluid is drained from the first chamber 54. Also, the second piston 30 is moveable along the longitudinal axis 42 between an extended position (FIG. 6) and a retracted position (FIGS. 2 and 3). In the extended position, pressurized fluid is supplied to the second chamber 58. In the retracted position, the pressurized fluid is drained from the second chamber 58.

In operation, the sprocket 130 is rotated continuously in the first direction 118 through alternating cyclic movement stages of actuating the arms 94, 106, as described in further detail below. In order to tighten a workpiece such as a fastener, the fastener is received within the socket 12 (FIG. 1), and the sprocket 130 rotates the socket 12 in a first direction 118 (FIG. 3). To loosen a fastener, the torque wrench 6 can be flipped to engage the fastener from the other side of the sprocket 130, which is still rotated in the first direction 118. The drive system 10 is driven by pressurized fluid once the fluid hose(s) are coupled to the first and second fluid ports 62, 66, respectively.

During a first stage of movement (FIG. 4), pressurized fluid is introduced into the first chamber 54 via the first passage 34 while pressurized fluid is simultaneously discharged from the second chamber 58 via the second passage 38. As a result of pressurized fluid filling the first chamber 54, the first piston 26 moves toward the extended position along the longitudinal axis 42 and fluid (e.g., oil, air, etc.) in the first portion 96*a* of the third chamber 96 adjacent the rod side 74 of the first piston 26 passes through the fluid passage 78 into the second portion 96*b* of the third chamber 96 adjacent the opposite end 100 of the body 92. In response to movement of the first piston 26, the first arm 94 and the first pawl 126*a* pivot in the first direction 118. Pressurized fluid is discharged from the second chamber 58 at the same time pressurized fluid enters the first chamber 54, and the second piston 30 moves concurrently with the first piston 26 but in the opposite axial direction. The second piston 30 therefore moves toward its retracted position while pressurized fluid is being discharged from the second chamber 58, and fluid is drawn into the fourth chamber 76 through the fluid passage 90. In response to movement of the second piston 30, the second arm 106 and the pawls 126*b*, 126*c* pivot in the second direction 122, as shown in FIG. 2.

In the first stage of movement, teeth of the first pawl 126*a* engage corresponding teeth of the sprocket 130 when the first pawl 126*a* moves in the first direction 118 to rotate the sprocket 130 in the first direction 118. In other words, the first pawl 126*a* and the sprocket 130 move together in the first direction 118. When the pawls 126*b*, 126*c* move in the second direction 122, teeth of the pawls 126*b*, 126*c* slide over the teeth of the sprocket 130 without engaging. The pawls 126*b*, 126*c* move relative to the sprocket 130 without driving the sprocket 130 in the second direction 122.

Figure 7:
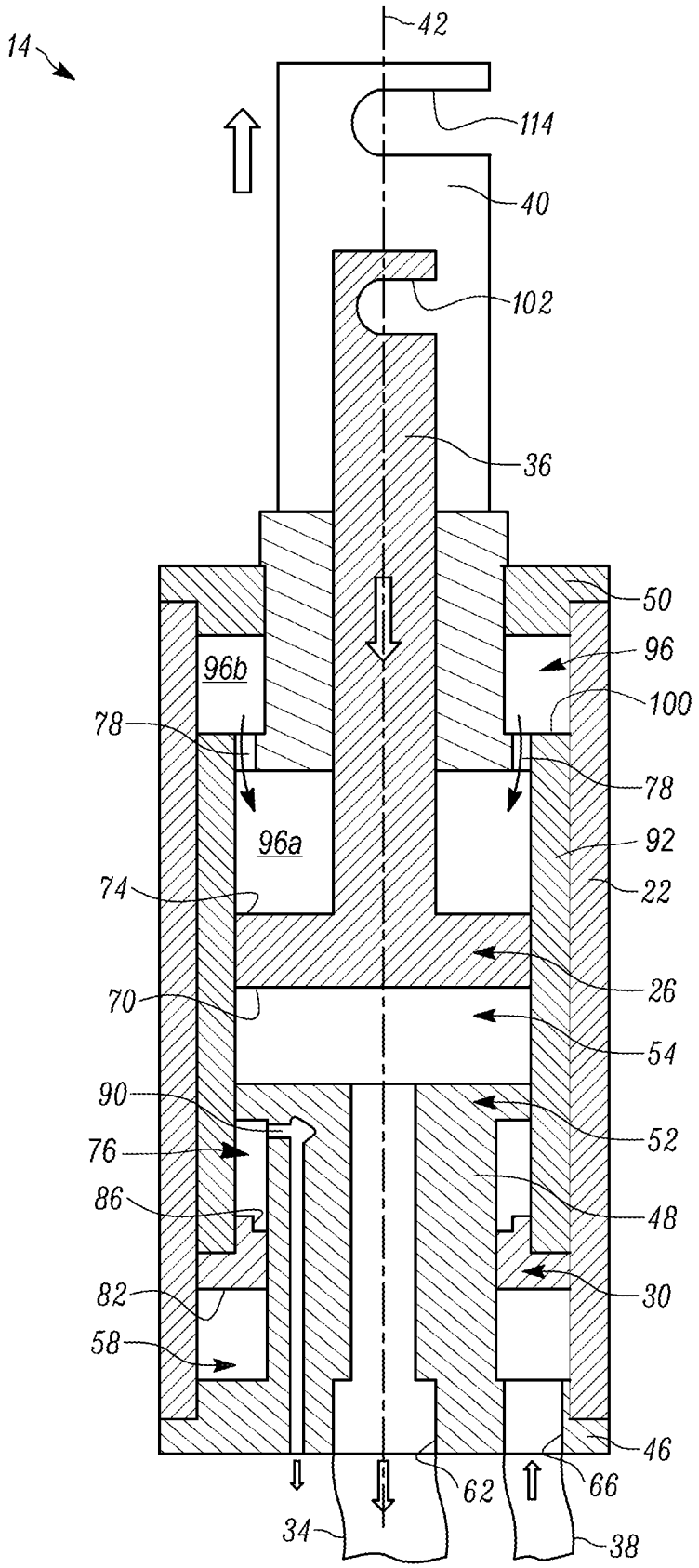
FIG. 7 is a cross-section view of the fluid actuator, illustrating pressurized fluid exiting the first chamber and entering the second chamber.

During a second stage of movement (FIG. 7), pressurized fluid is discharged from the first chamber 54 via the first passage 34 while pressurized fluid is simultaneously introduced into the second chamber 58 via the second passage 38. As a result of pressurized fluid entering the second chamber 58, the second piston 30 moves toward the extended position along the longitudinal axis 42 and fluid (i.e., oil, air, etc.) in the second portion 96*b* adjacent the opposite end 100 of the body 92 passes through the fluid passage 78 into the first portion 96*a* of the third chamber 96 adjacent the rod side 74 of the first piston 26. In response to movement of the second piston 30, the second arm 106 and the pawls 126*b*, 126*c* pivot in the first direction 118. Pressurized fluid is discharged from the first chamber 54 at the same time pressurized fluid enters the second chamber 58, and the first piston 26 moves concurrently with the second piston 30 but in the opposite axial direction. The first piston 26 therefore moves toward its retracted position while pressurized fluid is discharged from the first chamber 54 and fluid shifts from the third chamber second portion 96*b* to the third chamber first portion 96*a* adjacent the rod-side 74 of the first piston 26. Fluid in the fourth chamber 78 adjacent the rod side 86 of the second piston 30 can exit through the fluid passage 90. In response to movement of the first piston 26, the first arm 94 and the first pawls 126*a* pivot in the second direction 122, as shown in FIG. 6.

In the second stage of movement, teeth of the pawls 126*b*, 126*c* engage corresponding teeth of the sprocket 130 when the pawls 126*b*, 126*c* move in the first direction 118 to rotate the sprocket 130 in the first direction 118. In other words, the pawls 126*b*, 126*c* and the sprocket 130 move together in the first direction 118. In contrast, teeth of the first pawl 126*a* move in the second direction 122, and teeth of the pawl 126*a* move over the teeth of the sprocket 130 without engaging the sprocket 130. The first pawl 126*a* therefore moves relative to the sprocket 130 without driving the sprocket 130 in the second direction 122.

The first and second stages of movement alternate and repeat while the torque wrench 10 is activated or until the magnitude of torque reaches a predetermined torque value. Since the sprocket 130 is being positively driven in the first direction 118 during both stages (i.e., alternatively between pawl 126*a* and pawls 126*b*, 126*c*), the workpiece is rotated continuously in the first direction 118 rather than only being driven during one stage. In some instances, momentary pauses may exist between the first and second stages of movement in high pressure conditions. For example, the amount of torque required to fully tighten the workpiece increases toward the end of a tightening sequence, causing the amount of fluid pressure to drive the pistons 26, 30 to increase as well, which may cause momentary pauses due to pressure building in the chambers 54, 58.

The sprocket 130 is inhibited from rotating in the second direction 122 during each stage because the teeth of the pawls 126*a-c* and the sprocket 130 are asymmetrical, and each tooth has a relatively shallow slope on one edge and a relatively steep slope on the other edge. The edges of the pawls 126*a-c* with steep slope catch and engage edges of the sprocket teeth having a steep slope when the pawls 126*a-c* are driven in the first direction 118, while the edges of the pawls 126*a-c* having a shallow slope slide relative to the edges of the sprocket teeth having shallow slope in order to avoid catching one another when the pawls 126*a-c* rotate in the second direction 122 relative to the sprocket 130.

In the illustrated embodiment, when the pawls 126*a-c* move in the first direction 118, the pawls 126*a-c* have an angular displacement 134 that is constant for each stage. This is accomplished by the first cross-sectional area of the first cap side 70 of the first piston 26 being substantially the same as the second cross-sectional area of the second cap side 82 of the second piston 30. The equal cross-sectional areas ensure that the force exerted on the first piston 26 by the fluid in the first chamber 54 is the substantially equal to the force exerted on the second piston 30 by the fluid in the second chamber 58, thereby actuating the pistons 26, 30 through the same distance. In some embodiments, linear movement of the first rod 36 (or the second rod 40) through its full stroke along the axis 42 causes the pawl 126*a* (or pawls 126*b*, 126*c*) to be displaced through an angle 134 between approximately 30 degrees and approximately 40 degrees about the axis of rotation 116 (FIG. 2) of the sprocket 130. In other embodiments, the angular displacement 134 is less than approximately 30 degrees. In other embodiments, the angular displacement 134 is greater than approximately 40 degrees.

In some embodiments, the torque wrench 10 may include one or more sensors for sensing the amount of torque applied by the sprocket 130 to the workpiece. The sensors can generate signals corresponding to the magnitude of torque which are subsequently sent to and interpreted by an external device, such as a controller. The controller communicates with the torque wrench 10 to indicate to a user when a predetermined torque has been reached or the controller can deactivate the torque wrench 10. The sensors may be pressure sensors, strain gauges, position sensors, other suitable sensors, or a combination thereof. Computer software may be included to allow the torque wrench 10 to perform a tightening operation of a fastener to the predetermined torque value following activation by a user.

The embodiment(s) described above and illustrated in the figures are presented by way of example only and are not intended as a limitation upon the concepts and principles of the present disclosure. As such, it will be appreciated that variations and modifications to the elements and their configuration and/or arrangement exist within the spirit and scope of one or more independent aspects as described.

The invention claimed is:

1. A hydraulic torque wrench comprising:

a drive system including, a cylinder including a first end, a second end, and a longitudinal axis extending therebetween, a closed volume including a first portion and a second portion in communication with the first portion, a first piston disposed within the cylinder and movable along the longitudinal axis, a first rod coupled to the first piston, a second piston disposed within the cylinder and movable along the longitudinal axis, and a second rod coupled to the second piston, fluid being transferred between the first portion and the second portion of the closed volume as one of the first piston and the second piston moves in an opposite direction relative to the other of the first piston and the second piston; and a working end driven by the drive system, the working end including a first arm coupled to the first rod, a second arm coupled to the second rod, and a socket operable to be driven by the first arm and the second arm.

2. The hydraulic torque wrench of claim 1, wherein the first arm includes a first pawl, the second arm includes a second pawl, and the socket includes teeth for engaging the first pawl and the second pawl, wherein the first pawl engages and rotates the socket in a first rotational direction in response to the first piston moving in a first axial direction, and the second pawl engages and rotates the socket in the first rotational direction in response to the second piston moving in the first axial direction.

3. The hydraulic torque wrench of claim 2, wherein the first pawl slips relative to the teeth when moving in a second rotational direction opposite the first rotational direction, and wherein the second pawl slips relative to the teeth when moving in the second rotational direction.

4. The hydraulic torque wrench of claim 3, wherein the first pawl moves in the second rotational direction in response to the first piston moving in a second axial direction, and the second pawl moves in the second rotational direction in response to the second piston moving in the second axial direction.

5. The hydraulic torque wrench of claim 1, wherein a first chamber is positioned adjacent a side of the first piston and receives fluid to move the first piston and first rod in a first direction along the longitudinal axis, and wherein a second chamber is positioned adjacent a side of the second piston and receives fluid to move the second piston and second rod in the first direction.

6. The hydraulic torque wrench of claim 1, wherein the first piston includes a first cap side having a first area, wherein the second piston includes a second cap side having a second area substantially equal to the first area.

7. The hydraulic torque wrench of claim 1, wherein movement of the first piston is dependent on and in a direction opposite movement of the second piston.

8. The hydraulic torque wrench of claim 1, wherein a partition member is positioned between the first piston and the second piston, a first chamber positioned between the partition member and the first piston, and a second chamber positioned between the partition member and the second piston.

9. The hydraulic torque wrench of claim 1, wherein reciprocal movement of the first arm and the second arm drives rotation of the socket in a single direction of rotation.

10. The hydraulic torque wrench of claim 1, wherein the first portion of the closed volume is positioned between a rod side of the first piston and an end of the cylindrical body in which the first piston is movable, wherein the second portion of the closed volume is positioned in a the cylinder adjacent an end of the cylindrical body.

11. The hydraulic torque wrench of claim 1, wherein the second piston is a body supported for movement within the cylinder, wherein the first piston is positioned within the body of the second piston.

12. The hydraulic torque wrench of claim 11, wherein a partition member is positioned within the body of the second piston, wherein a first chamber is positioned within the body between the partition member and the first piston, and a second chamber is positioned within the body between the partition member and an end of the body.

* * * * *